United States Patent [19]

Gelina

[11] 4,371,091

[45] Feb. 1, 1983

[54] DOUBLE-SEAL MOLDED PLASTIC SCREW CAP

[75] Inventor: Robert P. Gelina, Vernon, Conn.

[73] Assignee: Apollo Molded Products, Rockville, Conn.

[21] Appl. No.: 226,956

[22] Filed: Jan. 21, 1981

[51] Int. Cl.[3] ..... B65D 41/04

[52] U.S. Cl. ..... 220/288; 215/329; 215/341

[58] Field of Search ..... 215/329, 341; 220/288, 220/304

[56] References Cited

U.S. PATENT DOCUMENTS 4,238,042 12/1980 Hatakeyama et al. ..... 215/341 X

FOREIGN PATENT DOCUMENTS 1205887 9/1970 United Kingdom ..... 215/341

*Primary Examiner*—George T. Hall

*Attorney, Agent, or Firm*—H. Gibner Lehmann; K. Gibner Lehmann

[57] ABSTRACT

A double-seal, molded plastic screw cap for use with a solid cosmetic product, consisting of a resilient, cup-shaped plastic cap body having internal screw threads, the bottom rim of the body being engageable with an external shoulder of the container to effect a seal therewith. Above the screw threads, the side wall of the body has an inwardly raised, annular sealing bead adapted to slidingly and telescopically engage an outer annular surface of the container neck at the top rim thereof, to effect a second seal. A clearance chamber exists above the sealing bead, into which a portion of the cosmetic product can extend. The clearance chamber is characterized by thin walls, to effect a saving of plastic material. The sealing bead is effective independent of the exact axial positioning of the cap, and the bottom rim seal of the cap requires that the latter be tightly screwed onto the container.

3 Claims, 5 Drawing Figures

DOUBLE-SEAL MOLDED PLASTIC SCREW CAP

BACKGROUND

This invention relates to plastic screw caps for use with small hand held containers, such as are provided to hold and dispense cosmetic products. More particularly, the invention relates to such caps wherein a plurality of seals is provided to insure the preservation of the cosmetic product during shipping and storage, extended shelf life, etc.

In the past various types of plastic screw caps having multiple seals have been proposed and produced. Some of these prior screw caps have involved deformable depending skirts of flanges, whereas others have involved plug formations insertable in the neck of the cooperable container. The prior caps have in most cases not only involved complicated mold forms which were expensive, but also required the use of a substantial amount of plastic material in order to effect the desired double sealing function. Thus, there was entailed a considerable mold cost and in addition the unit cost per cap was not inconsequential, particularly since the cost of the plastic molding material has now become a factor due to increasing petroleum costs.

Moreover, in many instances the configuration of the cap did not insure the preservation of the seals if the plastic material thereof deformed by reason of shrinkage, or adverse environmental factors.

SUMMARY

The above disadvantages and drawbacks of prior molded plastic screw caps are obviated by the present invention, which has for one object the provision of an improved double-seal screw cap which can be produced in especially simple, economical-to-fabricate molds while still insuring the preservation of the double seal under various conditions of use.

Another object of the invention is to provide an improved double-seal molded plastic screw cap, in accordance with the foregoing, wherein a minimum quantity of plastic material is required, thus reducing the unit cost to the greatest possible extent.

Yet another object of the invention is to provide an improved plastic screw cap as above set forth, which is especially reliable for the intended use in spite of the possibility of slight deformation or shrinkage occurring of the plastic substance.

A feature of the invention resides in the provision of an improved plastic screw cap as above characterized, which does not require alteration or extensive modification of the cooperable container neck.

In accomplishing the above objects, the invention provides a resilient cup-shaped plastic cap body having an annular side wall which is integral with a transverse top wall. The side wall has internal screw threads that are adapted for engagement with the external screw threads of the container neck. In the side wall of the cap body there is an annular sealing surface or bead which is disposed above the internal screw threads and between the latter and the top wall. The said sealing surface or bead is slidingly and telescopically engageable with the outer annular surface of the container neck at the top rim thereof, to provide a first seal therewith. The bottom edge of the annular side wall of the cap body is perfectly flat and directed downwardly for abutting engagement with a cooperable shoulder of the container neck to provide a second seal therewith.

The annular sealing bead of the cap and sealing bottom edge are spaced apart a distance equal to the spacing of the cooperable surfaces of the container neck, with the being essentially independent of the precise axial position of the cap for effecting its sealing function. Above the sealing bead, the cap has a clearance chamber in which a portion of the cosmetic product can extend and be disposed, such clearance chamber being characterized by especially thin walls to effect an economy in the use of the plastic material.

Other features and advantages will hereafter appear.

Figure 1:
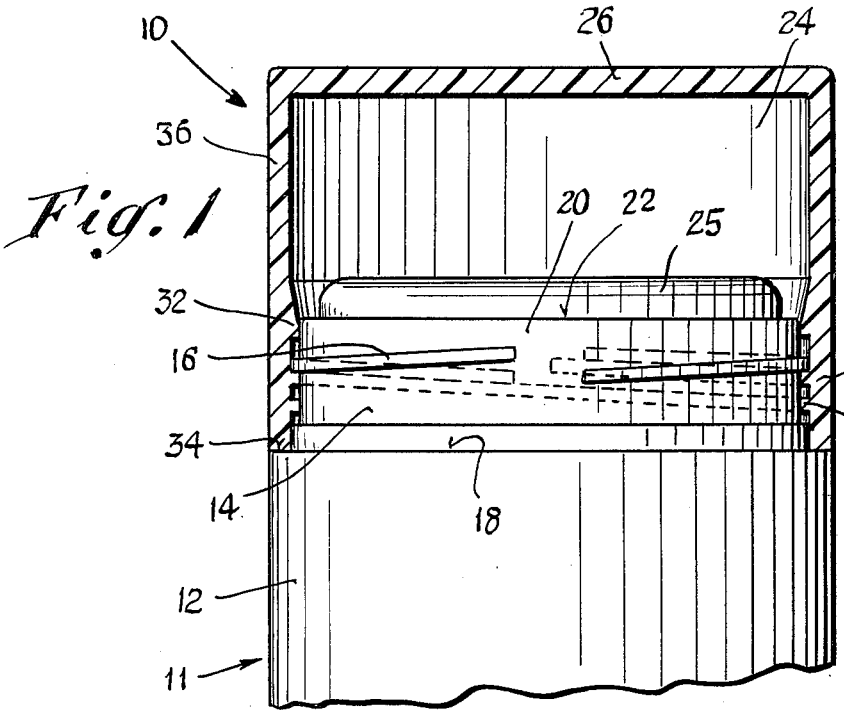
FIG. 1 is an axial view showing the improved cap in axial section and the cooperable container in side elevation, with the cap in its double-seal position on the container.
Figure 3:
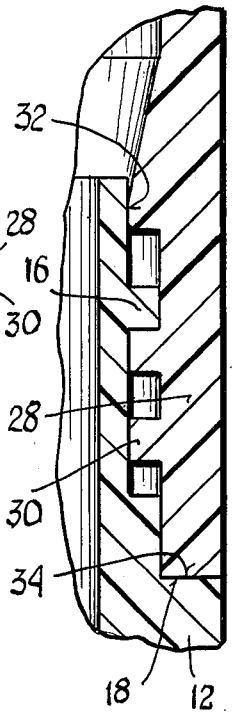
FIG. 3 is a fragmentary sectional view, enlarged, of the double seal structure adjoining the screw threads, as provided by the invention.
Figure 2:
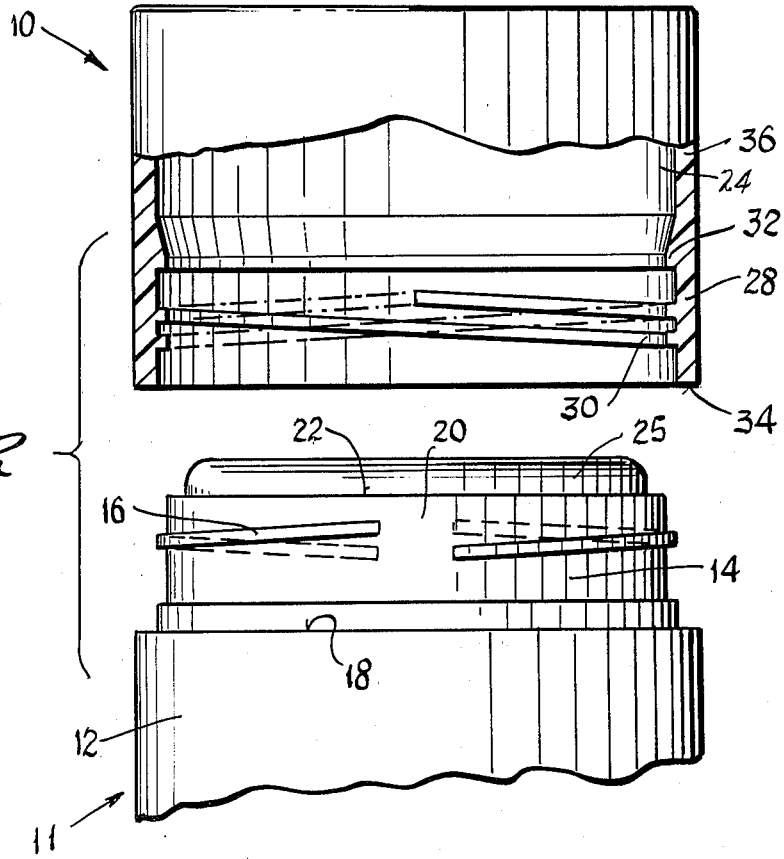
FIG. 2 is an exploded view showing the improved cap in axial section, removed from the container which latter is in side elevation.

As shown, the screw cap of the invention is designated broadly by the numerl 10, being adapted for use with a container 11 of generally conventional configuration.

The container 11 has a body portion 12 and a neck portion 14, the latter being provided with a usual type of external screw thread 16. Between the neck portion 14 and the body portion 12, the container has an exterior annular shoulder 18 which is accurately formed to lie in a perfectly flat plane. Above the screw threads 16 the neck portion 14 of the container has an annular, exterior, smooth sealing surface 20 located at the top rim or edge 22.

In accordance with the present invention, the exterior shoulder 18 and the sealing surface 20 of the container 11 are intended to cooperate with mating surfaces or portions of the screw cap 10 to effect a reliable double seal.

The container 11 can carry a solid cosmetic product such as a deodorant stick 25 which normally protrudes from the neck portion 14 as shown.

In accordance with the invention the screw cap 10 is formed in a unique manner to provide a first, sliding seal engageable with the surface 20 of the neck 14 and which is independent of precise axial positioning of the cap, and a second seal cooperable with the shoulder 18 of the container to provide a second seal which depends on the screw cap 10 being tightly screwed onto the container.

Also, the invention provides that the screw cap 10 have a clearance chamber 24 above the screw threads and under its transverse top wall 26 to accomodate a portion of the cosmetic product 25, such chamber being characterized by especially thin walls to effect a saving in the material that is required in molding the cap.

The screw cap 10 comprises an annular side wall 28 which is integral with the top wall 26 and which has internal screw threads 30 for engagement with the external threads 16 of the container neck 14.

The side wall 28 of the cap body has an annular sealing surface comprising an inwardly raised annular bead 32 which is located above the internal screw threads 30 and between the latter and the top wall 26. The sealing surface or bead 32 is slidingly and telescopically engageable with the outer annular surface 20 of the container neck adjacent the top rim 22 thereof, to provide a first seal which is independent of the precise axial positioning of the cap.

The annular side wall 28 of the cap body has a perfectly flat, downwardly-directed annular sealing surface 34 on its bottom edge, for abutting engagement with the cooperable shoulder 18 of the container neck to provide a second seal therewith.

The annular surfaces 32 and 34 of the cap are spaced apart a distance equal to the spacing of the annular surface 20 and shoulder 18 of the container, thereby to effect simultaneous seals therewith. The annular side wall of the cap, where it is designated 36, extends upward to the top wall 26 from the annular sealing surface 32 so as to provide the clearance chamber 24, in which a portion of the cosmetic product 25 is disposed. The walls of the clearance chamber 24 can be especially thin whereby the inside diameter in the chamber is greater than the inside diameter of the sealing bead 32. That is, the wall thickness of the bead 32 is greater than the wall thickness of the chamber 24 whereby an appreciable saving of plastic material is had.

It will be noted that if the plastic material of the screw cap should shrink slightly to reduce cap diameter, this will cause the sealing bead 32 to more snugly engage the cooperable sealing surface 20 of the container neck. Thus, the seal at such point is not adversely affected.

A polypropylene plastic formulation has been found to be satisfactory for use in molding the present cap, since it has the desired resilience and stiffness, and enables the cap to be readily stripped from the mold without requiring an unscrewing movement.

Figure 5:
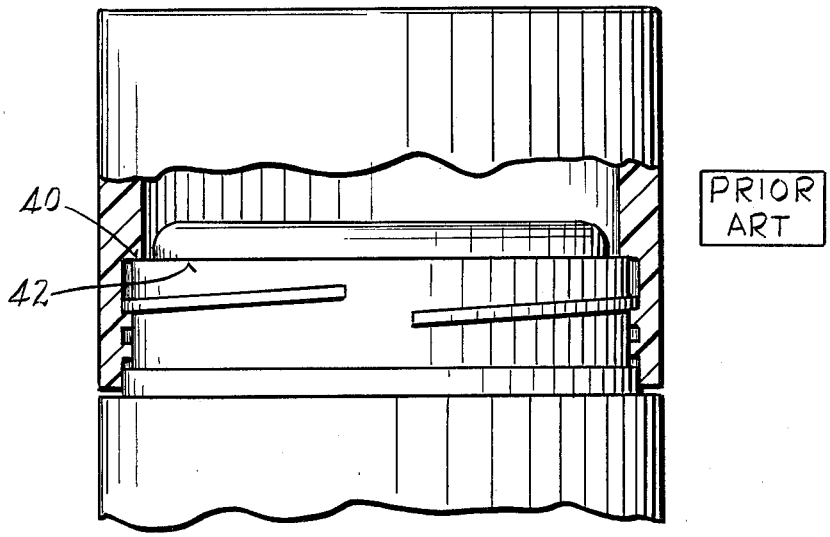
FIG. 5 is a view partly in axial section and partly in side elevation, of a cap and container representing prior art.
Figure 4:
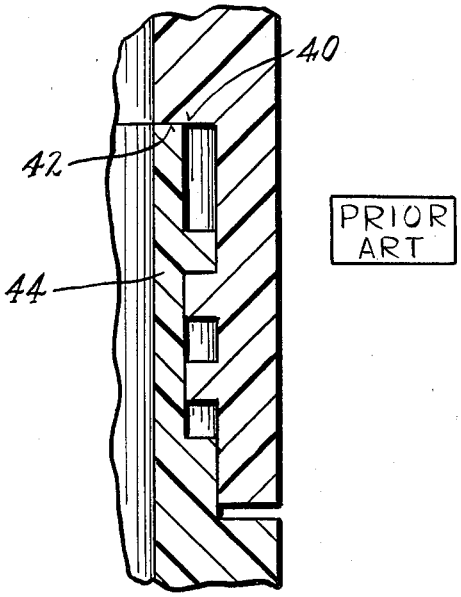
FIG. 4 is a view like FIG. 3 but showing the single seal of the prior art.

FIG. 5 shows a cap and container according to the prior art. The cap is molded of rigid plastic, and has a sealing shoulder 40 which is abuttingly engageable and sealable with the top surface 42 of the rim of the container neck 44. The seal depends on the cap being screwed down tightly, and is not effective for slightly different axial positions of the cap on the container as with the present invention.

It will now be seen from the foregoing that I have provided a unique, especially simple double-seal molded plastic screw cap for use with a threaded neck container, wherein the cap can be fabricated in simple, inexpensive molds and wherein there is not required any extensive modification of the cooperable container. The screw cap utilizes a minimum of plastic substance, which recently has become increasingly expensive due to the rise in cost of petroleum products.

Variations and modifications are possible without departing from the spirit of the claims.

I claim:

1. A double-seal molded plastic screw cap for use with a threaded-neck container of the type intended to hold a solid cosmetic product having a volatile ingredient, said screw cap comprising, in combination:

(a) a resilient cup-shaped plastic cap body having an annular side wall integral with a transverse top wall, said side wall having internal screw threads adapted for engagement with the external screw threads of the container neck, (b) said side wall of the cap body having an annular sealing surface disposed above the internal screw threads and between the latter and the top wall, said sealing surface being slidingly and telescopically engageable with the outer annular surface of the container neck at the top rim thereof, to provide a first seal therewith, (c) said annular side wall of the cap body having a perfectly flat downwardly-directed annular sealing surface on its bottom edge for abutting engagement with a cooperable shoulder of the container neck to provide a second seal therewith, (d) said annular sealing surfaces of the cap being spaced apart a distance equal to the spacing of the outer annular surface and cooperable shoulder of said container, thereby to effect simultaneous seals therewith, (e) the annular side wall of the cap extending upward to said top wall past the annular sealing surface therein, so as to provide a clearance chamber in which a portion of said cosmetic product can extend and be disposed.

2. A double-seal plastic cap as in claim 1, wherein:

(a) the inside diameter in said clearance chamber is greater than the inside diameter of the annular sealing surface of the side wall, and (b) the thickness of the side wall at the sealing surface is greater than the wall thickness surrounding the clearance chamber.

3. A double-seal plastic cap as in claim 2, wherein:

(a) The annular sealing surface above the internal screw threads comprises a bead which is raised with respect to upper and lower bordering inner surfaces of the side wall of the cap.

* * * * *